United States Patent [19]

Kagan

[11] Patent Number: 4,682,966

[45] Date of Patent: Jul. 28, 1987

[54] BALANCING FIGURE TOY BUILDING BLOCKS

[76] Inventor: Neil Kagan, 3412 Cypress Dr., Falls Church, Va. 22042

[21] Appl. No.: 909,330

[22] Filed: Sep. 19, 1986

[51] Int. Cl.[4] ..... A63H 33/00

[52] U.S. Cl. ..... 446/101; 446/124; D21/108

[58] Field of Search ..... 446/101, 117, 124; D21/108, 154

[56] References Cited

U.S. PATENT DOCUMENTS

| | | | |
|---|---|---|---|
| Re. 20,652 | 2/1938 | Hecht . | |
| D. 52,546 | 10/1918 | Schmelzer . | |
| D. 58,462 | 7/1921 | Diefenbach . | |
| D. 143,272 | 12/1945 | Dabrohua . | |
| D. 143,939 | 2/1946 | Shuman . | |
| D. 144,982 | 6/1946 | Plumer . | |
| D. 241,757 | 10/1976 | Goldfarb . | |
| D. 274,444 | 6/1984 | Symons . | |
| 1,648,199 | 4/1922 | Sargent . | |
| 2,078,709 | 4/1937 | Hecht | 446/101 |
| 2,106,148 | 1/1938 | Kellner . | |
| 2,377,616 | 6/1945 | Davis . | |
| 3,477,167 | 11/1969 | Ach | 446/101 |
| 3,870,312 | 3/1975 | Hamar . | |

*Primary Examiner*—Victor N. Sakran
*Attorney, Agent, or Firm*—Parkhurst & Oliff

[57] ABSTRACT

A human-like toy figure comprising a profile having distinct arms, legs, head and torso portions, having sufficient thickness that it will stand in a variety of orientations on its arms, legs, head or combinations thereof, with an imaginary central plane passing front-to-back through its head and torso, with the center of gravity of said figure lying to one arm/leg side of the central plane.

22 Claims, 21 Drawing Figures

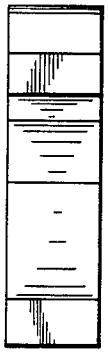
FIG. 4
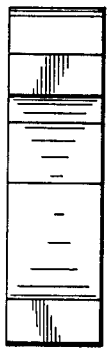
FIG. 5
FIG. 6
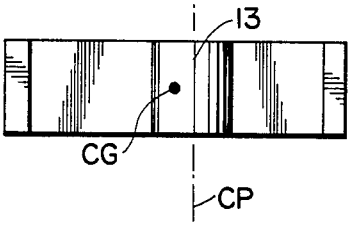
FIG. 7
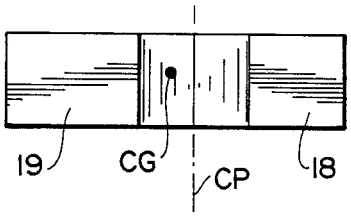
FIG. 8
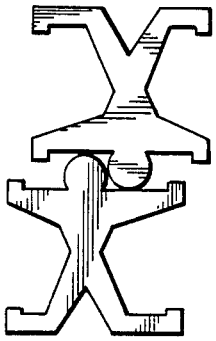
FIG. 9
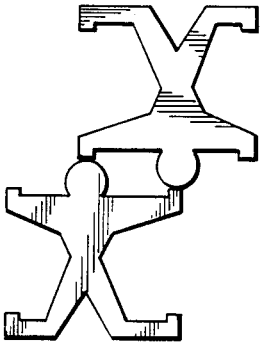
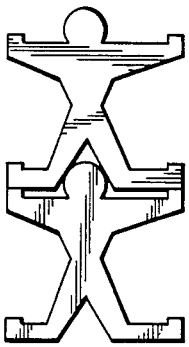
FIG. 10

BALANCING FIGURE TOY BUILDING BLOCKS

BACKGROUND

The present invention relates to toy blocks, and more particularly to freestanding, balancing figure, toy building blocks which may be used alone, or in combinations, in free-standing form, without other connecting elements.

Toy blocks in various simple geometric configurations are, and long have been, well known. Additionally, toy blocks have heretofore been known in a variety of configurations which include various symmetrical forms imitating the general shape of the human body. Among such known prior toy block designs are those disclosed, for example, in Schmelzer U.S. Pat. No. Des. 52,546; Diefenbach U.S. Pat. No. Des. 58,462; Sargent U.S. Pat. No. 1,648,199; Hecht U.S. Pat. No. R. 20,652 (a reissue of U.S. Pat. No. 2,078,709); Dabrohua U.S. Pat. No. Des. 143,272; Shuman U.S. Pat. No. Des. 143,939; Plumer U.S. Pat. No. Des. 144,982; Symons U.S. Pat. No. Des. 274,444, and a publicly known, circa 1950, building block somewhat like that disclosed in the aforementioned Hecht patent. Other known toy figures, some of which include moving parts or require additional interactive elements, include those disclosed, for example, in Kelner U.S. Pat. No. 2,106,148; Davis U.S. Pat. No. 2,377,616; Hamar U.S. Pat. No. 3,870,312 and Goldfarb U.S. Pat. No. Des. 241,757.

The value of toys in child development is well known. Children begin to stack blocks at the age of 12–14 months, and continue to refine such basic skills throughout early childhood. As young children develop, and particularly in the age span of one to three years, the child is acquiring new skills for conceptualizing the world in which he finds himself, and from day to day finds new ways of expressing his conceptualization of that world. Those expressions include attempts to re-create the child's mental pictures of the world around him, and toys may be used by a child to re-create such images. Thus particularly during the ages of 3–7 years, blocks are used as a tool for creative, imaginative play. Blocks, building blocks and figure blocks assist the child in pretend play, provide the child with objects for communication, jesturing, and particularly, development of a sense for spatial relationships. They also provide a vehicle for development of the child's fine motor activities. Building blocks which resemble a human figure readily lend themselves to pretend play which encourages verbal skills and provides an opportunity for a child to express feelings about other people and himself.

BRIEF SUMMARY OF THE INVENTION

Accordingly, it is the object of the present invention to provide new and even more useful toy building block.

It is an additional object of this invention to provide freestanding, balancing figure, toy building blocks.

Still further, it is an object of the present invention to provide freestanding, balancing figure, toy blocks wherein the mass of each block is distributed such that the center of gravity of the block lies to one side of the center line of the block, thus providing a variety of new and different configurations in which such blocks, either individually or collectively, can be oriented and used vis-a-vis each other.

In accordance with the foregoing objects, the present invention comprises an human-like toy figure comprising a profile having distinct arms, legs, head and torso portions, the figure having sufficient thickness so that it will stand in a variety of orientations on its arms, legs, head or combinations thereof, with the figure having an imaginary central plane passing through its head and torso, the total mass of the figure being distributed so that a distinct majority of the mass, or the center of gravity of the figure, lies on one arm/leg side of the central plane of the figure. Such figures can be used singly, or in a plurality, to form a variety of structural configurations.

BRIEF DESCRIPTION OF THE DRAWINGS

FIGS. 4 and 5 are left and right side views, respectively, of a toy figure block of the present invention, as illustrated in FIG. 1.

FIG. 6 is a top view of a toy figure block of the present invention as illustrated in FIG. 1.

FIG. 7 is a bottom view of a toy figure block of the present invention as illustrated in FIG. 1.

FIGS. 8 and 9 each show a pair of the toy figure blocks of the present invention in paired configurations illustrating the asymmetrical mass of each figure vis-a-vis the center line of the figure.

FIGS. 10–19 illustrate, in profile form, a pair of toy figure blocks of the present invention in a variety of stable, structural configurations illustrating the functions and interactions of various portions of the toy figure blocks of the present invention.

FIGS. 19–21 illustrate exemplary configurations in which a greater plurality of the toy figure blocks of the present invention may be related in stable structures.

DETAILED DESCRIPTION

Figure 1:
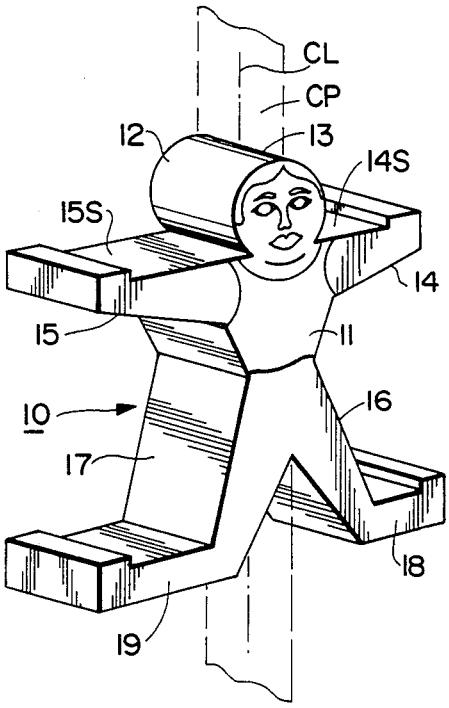
FIG. 1 is an isometric view of a toy figure block of the present invention.
Figure 2:
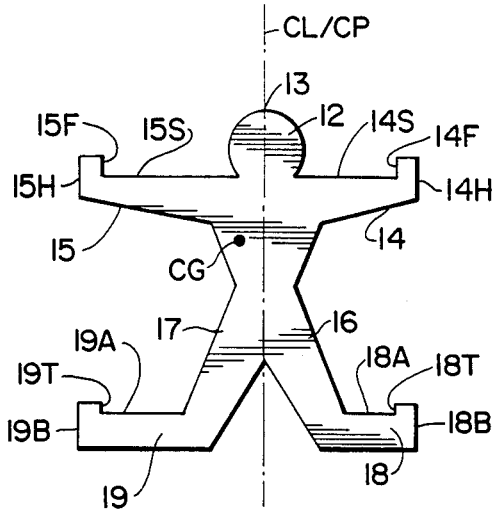
FIG. 2 is a front view of a toy figure block of the present invention as that illustrated in FIG. 1.
Figure 3:
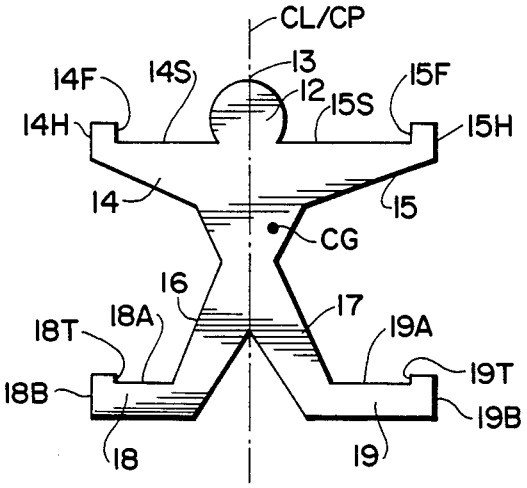
FIG. 3 is a back view of a toy figure block of the present invention as shown in FIG. 1.

As shown in FIGS. 1, 2 and 3, the toy block figure of the present invention basically comprises a human-like figure comprising a profile having distinct arms, legs, head and torso portions. While the illustration of FIG. 1 includes a face and clothing painted on at least a portion of the toy figure block of the present invention, any such ornamental coloring or configurations may be placed on the exterior surfaces of the toy block of the present invention. While the block as illustrated herein, as particularly indicated in FIG. 1 and FIGS. 4–7, is shown formed of a unitary piece having a single uniform thickness, the thickness of the block may vary in certain portions of the figure, so long as the block otherwise includes the other characteristics, and performs in the manner disclosed and claimed herein. One simple way of preparing the blocks of the present invention is to cut the profile of the block from an appropriate thickness of wooden board. For example, the blocks of the present invention may be successfully prepared by cutting same with a jigsaw or bandsaw from wooden boards having a thickness which is preferably in excess of about one inch. Alternatively, the inventive blocks may be molded or otherwise formed of any other suitable material, such as plastic, rubber, or any other settable composition.

Returning to the figure illustrated in FIGS. 1–3, it will first be noted that the torso and head portions of the figure are typically substantially symmetrical about a center line CL or center plane CP, each of which is illustrated in phantom lines in the drawings. The head portion 12 is typically circular and connected by a chord-like region to the torso portion 11, which chord-like portion is typically somewhat shorter than the diameter of head portion 12. While the head portion 12 may, in various embodiments, comprise any desirable shape, as illustrated herein the head portion 12 is cylindrical in shape, and includes a top, crown-line 13 which is the uppermost surface line of the figure when the figure is standing upright.

Additionally, the toy figure block of the present invention includes arm portions 14 and 15, one of which is typically somewhat longer than the other. As illustrated in FIG. 1 and the front profile shown in FIG. 2, the right arm 15 of the block FIG. 10 is shown to be somewhat longer than the left arm 14. The upper portion of each of the arms forms a continuous line with the shoulder region of the figure so that there is a continuous, flat, substantially horizontal area on the upper side of the arm/shoulder region of the figure, on each side of the head, when the figure is in its upright position. As illustrated in FIG. 1 and FIG. 2, the left arm/shoulder area 15S is somewhat longer and larger than the right arm/shoulder area 14S.

As further shown in FIGS. 1–3, each of the arms terminates in a flat, vertical surface 14H and 15H, respectively, which surface may be compared to the back of the human hand, or the portions of the fingers which join directly to the hand. Additionally, this terminal or hand-like portion of each arm of the figure of the present invention includes an interior vertical surface 14F, 15F which forms a substantially right angle notch with the corresponding arm/shoulder surface 14S, 15S, which notch we shall herein refer to as the finger notch.

As illustrated herein, the surfaces which form the various limbs and notches described herein are all substantially normal in direction to the two major surfaces which form the front and back profiles of the figure as illustrated in FIGS. 2 and 3.

Figure 11:
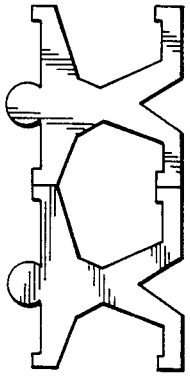

Furthermore, as illustrated in FIGS. 1–3, the toy figure block of the present invention comprises leg portions 16 and 17, which are substantially symmetrical about the center plane CP and center line CL. However, each of the legs terminates with a foot portion, 18 and 19, respectively, and the bottom of each of the foot portions is flat, being substantially normal both to the front and back surfaces illustrated in FIGS. 2 and 3, as well as being substantially normal to center line CL or center plane CP. Thus, when the figure is standing upright, the bottoms of feet portions 18 and 19 form the base of the figure. The feet portions also comprise flat arch regions 18A and 19A, respectively, and each of the feet terminates with a toe portion having substantially flat, vertical exterior portions 18B and 19B respectively, and additional internal vertical surfaces 18T and 19T which intersect arch portions 18A and 19A, respectively, to form a substantially right angle notch which we hereinafter will call the toe-notch. As with the left and right arm portions 14 and 15, respectively, the left and right feet 18 and 19 are of different sizes, the right foot 19 as illustrated in FIGS. 1 and 2 being longer than the left foot 18, in the same direction and to the same extent as the right arm 15 is longer than the left arm 14. The length of the left and right arms and feet, respectively, is such that the planes in which the external left hand surface 14H and external left toe surface 18B, and those planes in which the corresponding right hand surface 15H and right external toe surface 19B, respectively lie, define a single substantially vertical plane bounding each side of the toy figure block of the present invention. The planar nature of the sides of the blocks is perhaps accentuated by the illustrations, in profile form, of pairs of blocks as shown in FIGS. 10 and 11.

It will be appreciated from the drawings of FIGS. 1–3, that if the toy figure block of the present invention is formed of a material of substantially uniform thickness and of substantially uniform density that the center of gravity of the figure will lie to one side of the center line CL or center plane CP of the figure, namely to the right side of the center line or center plane as illustrated in FIGS. 1–3. For this reason a representative point, labelled CG, illustrates the fact that the mass of the figure of the present invention is asymmetrical with respect to the center line CL or center plane CP, so that the center of gravity lies to one side of that center line or center plane, typically to the side of the center line or center plane upon which the longer arm and leg, respectively, lie.

FIGS. 4 and 5 which respectively illustrate the left and right side views of the toy figure block of the present invention as illustrated in FIG. 1, are virtually identical, since in the embodiment illustrated in FIG. 1 the elevations of the various elements of the inventive toy figure block are substantially the same.

FIG. 6 illustrates a top view of the inventive toy figure block of the present invention, particularly noting the asymmetrical center of gravity vis-a-vis the center line or center plane, and noting the location of the crown line on the top of the head of the figure. Similarly, FIG. 7 shows a bottom view of the figure, again illustrating the asymmetry of the center of gravity with respect to the center plane CP, and clearly illustrating the greater bottom surface area of right foot 19 vis-a-vis the lesser bottom area of right foot 18.

The remaining figures herein illustrate various configuration in which one or more of the advantageous toy figure blocks of the present invention may be used, individually, or collectively, and how the various surfaces, corners, and notches of the advantageous toy figure blocks of the present invention interact when two or more such blocks are used together to build various structural configurations. Each of FIGS. 8–21 shows the figures only in front or back profile view. However, the reader will appreciate that it is intended in these figures that the portion of the figure having the greater mass is the side of the figure having the longer arm and foot.

The asymmetrical mass and offset center of gravity of the advantageous toy figure blocks of the present invention are of drammatically illustrated by the configurations shown in FIGS. 8 and 9. In FIG. 8 the crown line of the head of the upper figure is balanced on the arm/-shoulder portion of the heavier side of the supporting figure, while the asymmetrical mass of the upper figure causes that figure's longer arm/shoulder to bear down upon the crown line of the head of the supporting figure. If the advantageous toy figure blocks of the present invention did not have the asymmetrical mass feature, such interactions would not be possible. FIG. 9 shows a similar configuration in which the crown line of the upper figure is balanced on the top surface of the hand portion of the longer arm, while the corresponding hand portion of the upper figure bears upon the crown line of the head of the supporting figure. These figures also illustrate the fact that the uppermost surfaces of the hand/finger portions and toe portions, respectively, of each figure of the present invention are substantially coplanar and horizontal when the figure is upright.

FIG. 10 illustrates one figure standing upon the hands of a lower supporting figure, illustrating that the size and placement of the head of each figure vis-a-vis the spacing between the two legs of each figure is such that the head of the lower figure will fit perfectly between the legs of an upper figure.

As previously mentioned, FIG. 11 shows the coplanar nature of the hand and toe portion forming the exterior sides of the advantageous toy block figure of the present invention.

Figure 12:
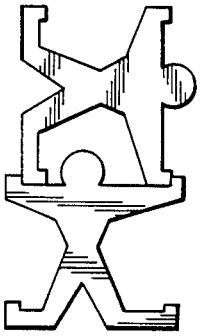

FIG. 12 illustrates the relationship between the distance between the interior finger notch surfaces of each figure is virtually identical and only slightly greater than the vertical distance between the sole of the foot and the upper surface of the hand on each side of each figure.

Figure 13:
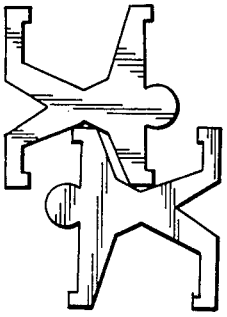
Figure 14:
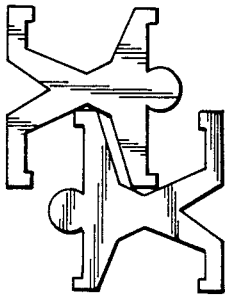

FIGS. 13 and 14 illustrate that the mass of each figure is such that either the short or long arms can be interleaved so that one figure will support another figure while the main center lines or central planes of the figures are substantially horizontal and the heads of the figures point in different directions.

Figure 15:
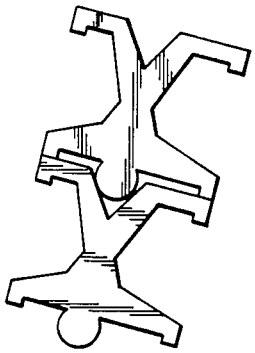

FIG. 15 is somewhat like FIG. 10 but illustrates the fact that the head of an upper figure will maintain that upper figure in inverted position balanced on the feet of a supporting figure, thus preventing the upper figure from sliding from the planar bottom surface of the feet of the supporting figure.

Figure 16:
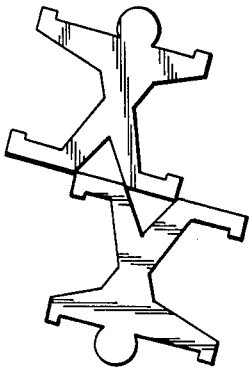

FIG. 16 illustrates the fact that the length of the shorter foot of each figure is only slightly shorter than the maximum distance between the heel portions of the feet of a figure, so that one figure may stand on its head and another figure may stand straddling the smaller foot of the inverted figure, with the smaller feet lightly interlocking in the spaces between the heels of the two figures.

Figure 17:
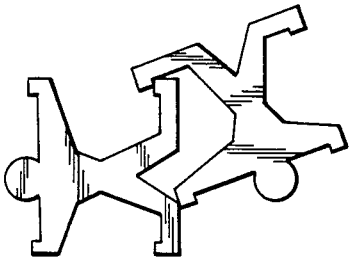

FIG. 17 illustrates how the toe notch of one figure may be used to grapple a toehold on an upper corner portion of another member of another figure, or any other similarly oriented surface.

Figure 18:
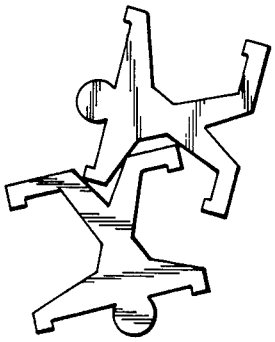

FIG. 18 illustrates another configuration in which two figures of the advantageous toy figure blocks of the present invention may be co-oriented.

As may now be expected from the variety of position and the numerous details of the design of the inventive toy figure blocks of the present invention, there is a wide variety of configurations in which a plurality of such figures may be used together as building blocks. Many of these configurations as shown in FIG. 8–18, place the figures in various positions much like teams of acrobats in a circus or other exhibition.

Figure 19:
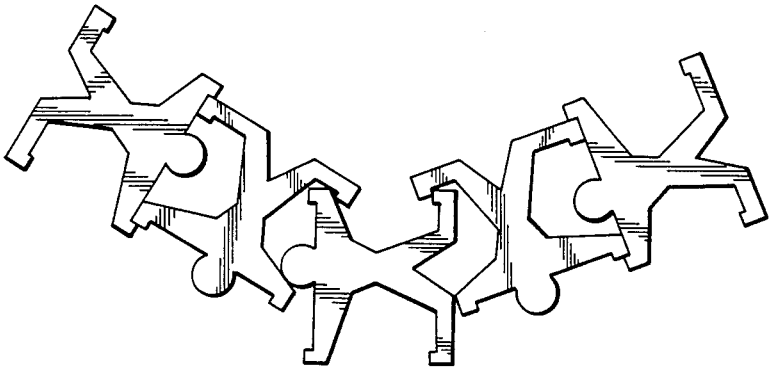

FIG. 19 shows five of the toy figure blocks of the present invention supported on a single block which is oriented horizontally on the hand and toe portions of one side. In this configuration, the outermost figures illustrate how the finger notch portions may be used to grapple a hold on a convex right angle corner on another figure or any such similar corner surfaces.

Figure 20:
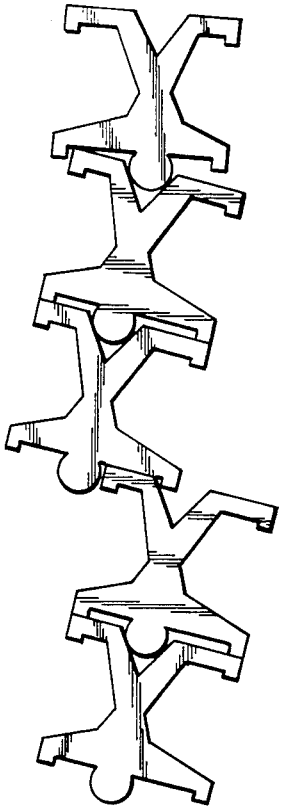

FIG. 20 illustrates an inverted balancing arrangement of five of the toy figure blocks of the present invention, and this illustration includes a showing that the bottom surface of the smaller foot is small enough to fit flush upon the upper arm/shoulder surface of the longer arm, as illustrated in the support of the third figure on its arm/shoulder in contact with the bottom of the smaller foot portion of the next to lowermost figure.

Figure 21:
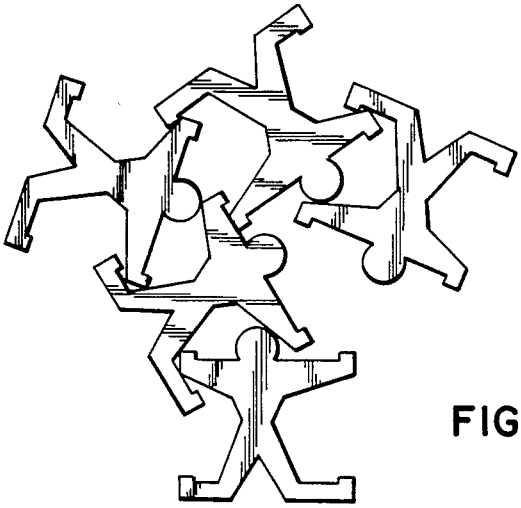

FIG. 21 illustrates still another configuration in which five of the toy figure blocks of the present invention may be coordinated, once again showing the grappling ability of the finger notch and toe notch portions of the figures, as well as other qualities of the invention such as its balanceability which is enhanced by its asymmetrical mass.

Additionally, FIGS. 19 and 21 illustrate another feature of the figures of the present invention wherein the size and length of the head/shorter arm combination are such that said combination will fit within the somewhat C-shaped opening defined by the leg/torso/arm combination on either side of the figure. FIG. 19 shows the head/shorter arm combination within the leg/torso/-shorter arm opening, and FIG. 21 shows the head/arm shorter arm combination within the leg/torso/longer arm opening. As illustrated in FIGS. 19 and 21 those relationships facilitate certain geometrical combinations of a plurality of the inventive figures.

From the foregoing it will be appreciated that there is a virtually unlimited number of configurations in which one or more of the advantageous toy figure blocks of the present invention may be coordinated, oriented stacked or otherwise combined to form a great variety of interesting desired structures or configurations. The specific configurations illustrated in FIGS. 1–21 above, are merely exemplary and are in no way intended to limit the utility of the advantageous toy figure blocks of the present invention.

What is claimed is:

1. A toy figure block comprising a profile having distinct arms, legs, head and torso portions, said figure having sufficient thickness that it will stand in a variety of orientations on its arms, legs, head or combinations thereof, said figure having an imaginary central plane passing front-to-back through its head and torso, with the center of gravity of said figure lying to one arm/leg side of said central plane.

2. The toy figure block of claim 1 having substantially uniform thickness with flat front and back profile surfaces, the remaining surfaces being substantially normal to said front and back profile surfaces.

3. The toy figure block of claim 2 wherein the head portion thereof is substantially cylindrical.

4. The toy figure block of claim 2 wherein the head, torso and leg portions thereof are substantially symmetrical about said central plane.

5. The toy figure block of claim 1 wherein each of the legs terminates with a foot portion the bottom surface of which is substantially normal to said central plane.

6. The toy figure block of claim 5 wherein one arm portion and one foot portion extend substantially normally outwardly on each arm/leg side of said central plane.

7. The toy figure block of claim 6 wherein the arm and foot portion on each side of said center line terminate in flat surfaces which are parallel to each other, the end of the arm and leg on each side of the central plane terminating in a common plane.

8. The toy figure block of claim 7 wherein the upper surfaces of each of the foot portions are substantially coplanar and are substantially normal to said central plane.

9. The toy figure block of claim 8 wherein the upper surfaces of each arm portion form substantially coplanar arm/shoulder surfaces which are substantially normal to said central plane.

10. The toy figure block of claim 9 wherein the outer end portion of each upper foot surface and arm/shoulder surface terminates at a planar surface which is substantially parallel to said central plane and forms a finger notch or toe notch with said upper foot or arm/-shoulder surface, respectively.

11. The toy figure block of claim 10 wherein each arm terminates with a hand/finger portion having an upper, surface substantially normal to said central plane.

12. The toy figure block of claim 10 wherein each foot portion terminates with a foot/toe portion having an upper, surface substantially normal to said central plane.

13. The toy figure block of claim 4 wherein the two leg portions are separated by a V-shaped notch region which is substantially large enough so that when two similarly oriented such figure blocks are stacked one on top of the other, said V-notched opening is sufficiently large to accommodate the head portion of the lower supporting figure.

14. The toy figure block of claim 6 wherein the distance between the foot bottom surface and upper finger surface on one side of the figure is slightly less than the total length of both arm/shoulder surfaces of said figure.

15. The toy figure block of claim 14 wherein the length of the bottom of the shorter foot portion, in a direction normal to said central plane, is slightly shorter than the maximum width of said V-notched portion between the inner or heel portions of the foot portions of said figure.

16. The toy figure block of claim 15 wherein the length of the bottom of the shorter foot portion, in a direction normal to said central plane, is slightly shorter than the length of the longer arm/shoulder surface.

17. A set of toy figure blocks comprising a plurality of toy figure blocks as described in claim 1.

18. The toy figure of claim 9 wherein the arm and foot portions on one side of the figure are shorter than the arm and foot portion on the other side of the figure.

19. The toy figure of claim 10 wherein the arm and foot portions on one side of the figure are shorter than the arm and foot portion on the other side of the figure.

20. The toy figure block of claim 18 wherein the head/shorter arm combination will fit within the somewhat C-shaped opening formed by the leg/torso/arm combination on at least one side of the figure.

21. The toy figure block of claim 18 wherein the head/shorter arm combination will fit within the somewhat C-shaped opening formed by the leg/torso/arm combination on either side of the figure.

22. The toy figure block of claim 9 wherein the head portion thereof is substantilly cylindrical.

* * * * *